United States Patent [19]

Shepherd

[11] 4,068,581

[45] Jan. 17, 1978

[54] ADDRESSING MACHINE

[76] Inventor: George E. Shepherd, 51 Pasteur, Dollard des Ormeaux, Quebec, Canada

[21] Appl. No.: 777,392

[22] Filed: Mar. 14, 1977

[30] Foreign Application Priority Data

Mar. 8, 1977 Canada ..... 273442

[51] Int. Cl.[2] ..... B41L 47/46

[52] U.S. Cl. ..... 101/53; 101/132.5

[58] Field of Search ..... 101/47, 48, 49, 52, 101/53, 55, 56, 132.5

[56] References Cited

U.S. PATENT DOCUMENTS

| | | | |
|---|---|---|---|
| 2,771,838 | 11/1956 | Federmitz | 101/53 |
| 3,053,176 | 9/1962 | Shepherd | 101/53 X |
| 3,230,871 | 1/1966 | Kooch et al. | 101/132.5 |
| 3,233,538 | 2/1966 | Ritzerfeld et al. | 101/132.5 X |
| 3,547,027 | 12/1970 | Gombavtt | 101/53 |
| 3,902,410 | 9/1975 | Shepherd | 101/53 |
| 3,996,854 | 12/1976 | Shepherd | 101/53 |

*Primary Examiner*—Edward M. Coven

*Attorney, Agent, or Firm*—Larson, Taylor and Hinds

[57] ABSTRACT

A small desk-type addressing machine with automatic card feeding and manual control for registration adjustment. The printing station uses a narrow large diameter segmented printing roll made of relatively soft rubber on an auxiliary shaft. A single clutch controls the card feeding and the moistening operations and serves to drive the printing roll. The frame housing is made of three interconnected sheet metal boxes with a prestressing element that maintains the cantilevered upper component a fixed distance above the table component. The upper component has a pivotable portion for giving access to the moistening station.

11 Claims, 13 Drawing Figures

ADDRESSING MACHINE

Figure 1:
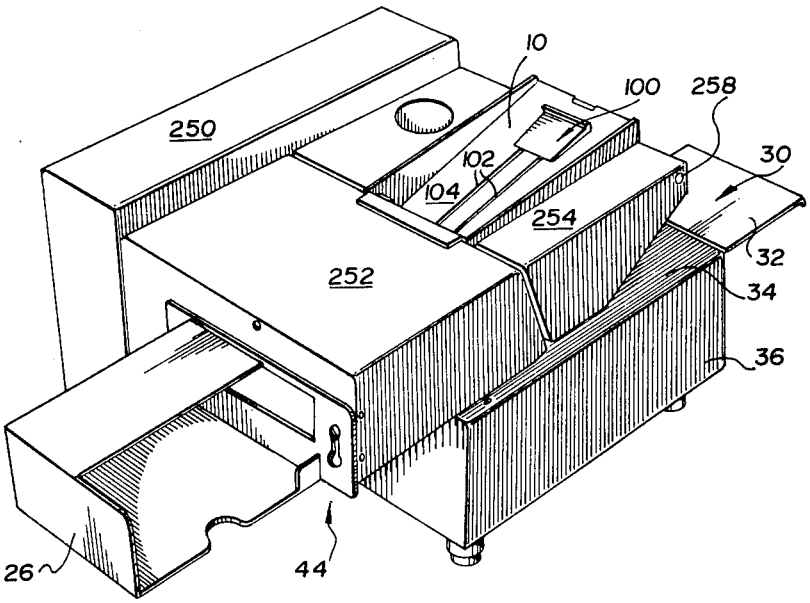

This invention relates to small addressing machines of the hectographic transfer type using master cards of the conventional type, and in particular to an improvement in the addressing machine disclosed in the inventor's prior U.S. Pat. No. 3,902,410 issued on Sept. 2, 1975 and entitled "Apparatus for printing with master cards".

A modern addressing machine of the hectographic type comprises a tray for receiving a stack of master cards, a card feeder which feeds one master card each time the machine senses the arrival of a workpiece to be printed, a moistening roll in communication with a supply of solvent and adapted to contact a small area of the workpiece to apply solvent thereto upstream from the printing station, and means for bringing together the master card and the workpiece and for feeding them to the printing station where substantial pressure is exerted upon the master card against the underlying workpiece. The printing station comprises a lower feed roll and an upper printing roll which are parallel and continuously rotating at the same linear speed with their peripheral surfaces in contact with each other. When the master card and the workpiece pass between these rolls, sufficient pressure is exerted to cause transfer of the matter printed on the back of the master card onto the surface of the workpiece where solvent had just been applied.

Proper registration of the printed area relative to the leading edge of the workpiece is quite important; and since the envelopes and other workpieces are of different sizes there must be an adjustment for the registration.

Experience has shown that hectographic addressing machines require the use of relatively powerful though small electric motors for driving the feeding and printing devices on account of the fact that a substantial force is required to maintain continuous rotation of the printing roll even when no workpieces are being fed. This is due to the fact that the printing roll and the underlying feed roll which are made of rubber, are pressed together to ensure a sufficient printing pressure. Flat spots tend to develop over these rolls when the machine is left unused for days or weeks. This is also true in addressing machines that use a second set of printing and feed rolls for producing a darker print.

I have discovered that by using a narrow printing roll in the shape of a segmented cylinder of relatively large diameter and made of relatively soft rubber, a hectographic addressing machine can be made which requires a very small driving motor, which provides print darkness comparable to that obtained with double printing, and which eliminates the problem of flat spotting of the printing station components.

I have also discovered that a very simple registration adjustment mechanism can be devised for an addressing machine using a segmented soft rubber printing roll of large diameter as above described. My invention also contemplates a particular housing construction for small addressing machines.

The object of the present invention is to provide a low cost hectographic addressing machine of greatly simplified design which affords dark printing, and a sufficiently wide registration variation and which may be driven by a comparatively small electric motor.

An other object of this invention is to provide an addressing machine whose housing is made of thin sheet metal components with a pre-stressing number for maintaining a fixed distance between the printing roll and feed roll axes.

A further object of this invention is to provide a housing for an addressing machine which affords direct access to the master card and workpiece feeding components for facilitating removal of jamming workpieces or master cards.

These objects and advantages can be obtained in a hectographic printing apparatus comprising a master card holder for receiving a stack of master cards, master card dispensing means for automatically feeding said master cards, card guiding means for translating dispensed master cards from said holder to a printing station and from said printing station to a master card discharge station, a first feed roll defining a workpiece receiving station, workpiece guiding means for translating workpiece from said workpiece receiving station to said printing station and from said printing station to a workpiece discharge station, drive means for rotating said first feed roll throughout every printing cycle, moistening means defining a moistening station upstream of said printing station for applying solvent only over the area of said workpiece to be printed, common actuating means for operating said master card dispensing means and for operating said moistening means in synchronism to insure that in every printing cycle the area of the workpiece being translated over which solvent is applied is in registry with the information bearing area of the master card being translated, sensing means for producing an electrical signal when the leading edge of a workpiece at said workpiece receiving station reaches a predetermined point in said apparatus, and registration adjustment means for adjusting the distance between the leading edge of a workpiece and the area of said workpiece to be printed, said registration adjustment means including a manual control for determining the angular displacement of said first feed roll taking place between the occurence of said electrical signal and the beginning of the operation of said common actuating means, said printing station comprising a second feed roll driven by said drive means, the linear speed of said first and second feed rolls being equal and in the same direction, said printing station also comprising a narrow segmented printing roll of relatively large diameter made of soft rubber or like material, and secured to an auxiliary shaft which is parallel to and spaced apart from the axis of said second feed roll, said shaft being normally freely rotatable, the distance between the axis of said auxiliary shaft and that of said second feed roll being fixed and sufficient to leave a gap between the non-circular portion of said printing roll and the periphery of said second feed roll, but said distance being sufficiently short to ensure substantial flattering of said printing roll by said second feed roll when their circular surfaces meet; said apparatus also comprising a printing roll driver for causing engagement of said second feed roll and printing roll by rotating said printing roll a fixed period of time after receiving said electrical signal, and printing roll stop means for setting the starting angular position of said printing roll each time the periphery thereof looses contact with said second feed roll thus maintaining said gap until the next operation of said printing roll driver.

In particular embodiments, the drive means consists of a small electric motor which maintains continuous rotation of said first and second feed rolls, wherein said printing roll driver comprises a single normally disengaging clutch having a driving member continuously rotating under the action of said small electric motor, and a driven member coupled to said auxiliary shaft for rotating same.

The coupling of the driven member and the auxiliary shaft provides lost motion for delaying rotation of said auxiliary shaft after engagement of said clutch which occurs practically simultaneously with said electrical signal, and the coupling consists of a radial projection in the driven member extending inwardly into a bore through which said auxiliary shaft extends, and a longitudinal projection in said auxiliary shaft interfering with said radial projection, the relative angular position of said projections being such as to permit rotation of said driven member from its engagement position over a predetermined angle before engagement of said projection takes place.

The common actuating means may comprise a slotted link having one end pivotally connected to a point of said driven member which is disposed at a predetermined distance from the axis of rotation of said driven member, a first cross-shaft having a first crank arm at its inner end and said moistening means at its outer end, a second cross-shaft having a second crank arm at its inner end and an actuating finger at its outer end, a secondary link extending between said first and second crank arms and pivotally connected thereto, and a pin extending through the slot at the other end of said slotted link and into said first crank arm, and said apparatus being further characterized in that said registration adjustment means comprises a plurality of closely spaced apart axial bores on the free end of said driven member, and a retractable pin extending through said slotted link into one of said bores which are all at said predetermined distance from the axis of rotation of the driven member.

The registration adjustment means may comprise a knob on the other end of a spring loaded shaft whose axis coincides with that of said auxiliary shaft, and a small arm secured to the inner end of said spring loaded shaft and carrying said retractable pin.

The frame housing may consist of a table component, a back component secured to the table component and a cantilevered component secured to the back component and disposed over said table component leaving a space therebetween for passing said workpieces, said cantilevered component having a horizontal member extending over said workpiece receiving station and over said moistening station and defining said master card holder, said horizontal member being pivotally connected to said frame housing so as to be pivoted to an open position for giving access to said workpiece receiving station and to said moistening station; the table component, back component and cantilevered components are made of sheet metal and comprise a vertical prestressing bar of great stiffness secured into said back component to said table component and to said cantilevered component in the vicinity of said auxiliary shaft, and a screw threading into said prestressing bar and urging the free end thereof away from the underlying portion of said frame housing.

Figure 2:
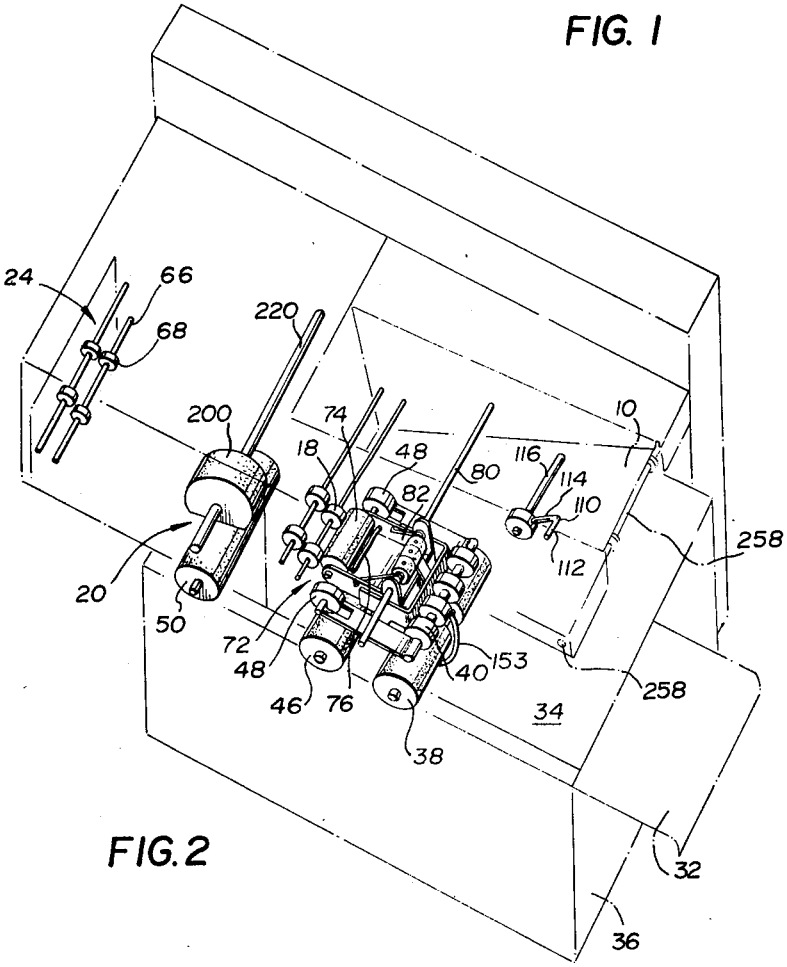
Figure 3:
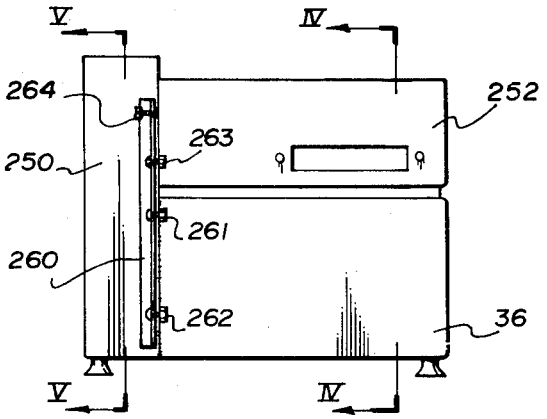
Figure 4:
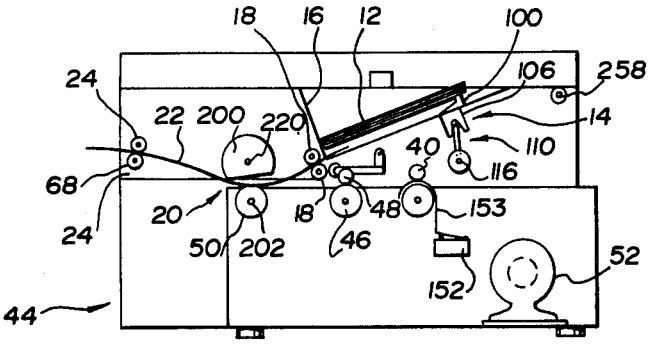
Figure 5:
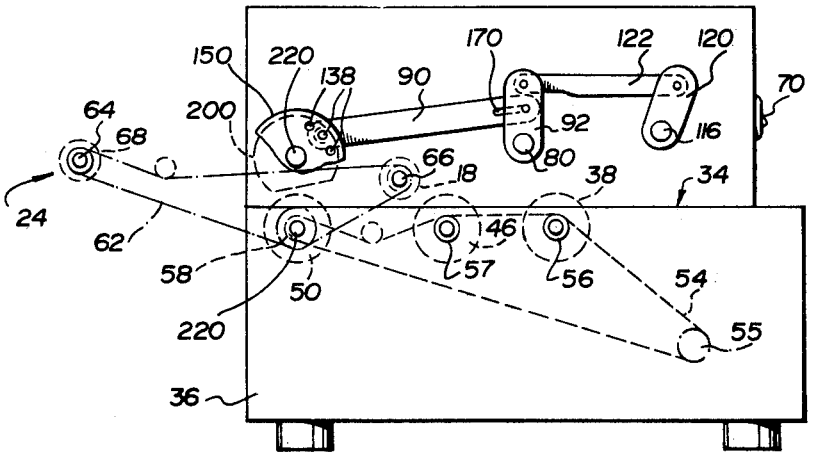
Figure 6:
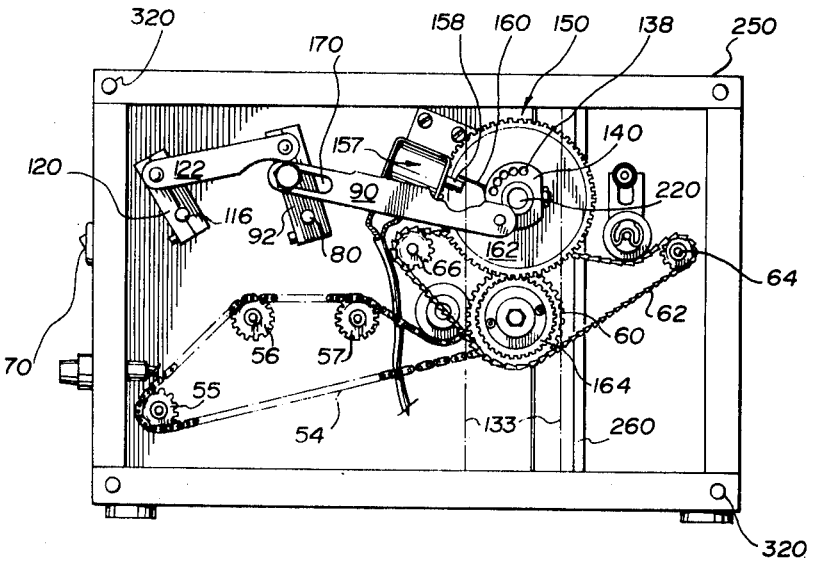

An examplary preferred embodiment of this invention is illustrated in the accompanying drawings wherein:

FIG. 1 is a perspective view of a small desk-type addressing apparatus in accordance with this invention, FIG. 2 is a different perspective view of the apparatus illustrated in FIG. 1 but showing internal components and their relative position in the apparatus, FIG. 3 is a side elevational view of the right hand side of the apparatus shown in FIGS. 1 and 2, FIG. 4, on the sheet of FIG. 1, is a simplified cross-sectional view taken along line IV—IV of FIG. 3, FIG. 5 is a diagrammatic cross-sectional view taken along line V—V of FIG. 3, FIG. 6 is a rear elevational view of the apparatus shown in FIG. 1 but with the back panel removed.

Figure 7:
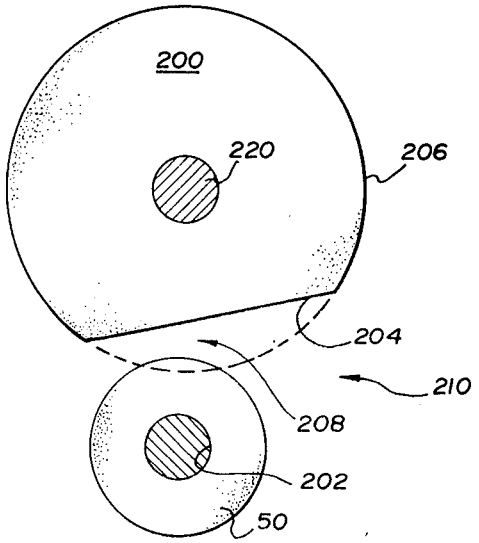
Figure 8:
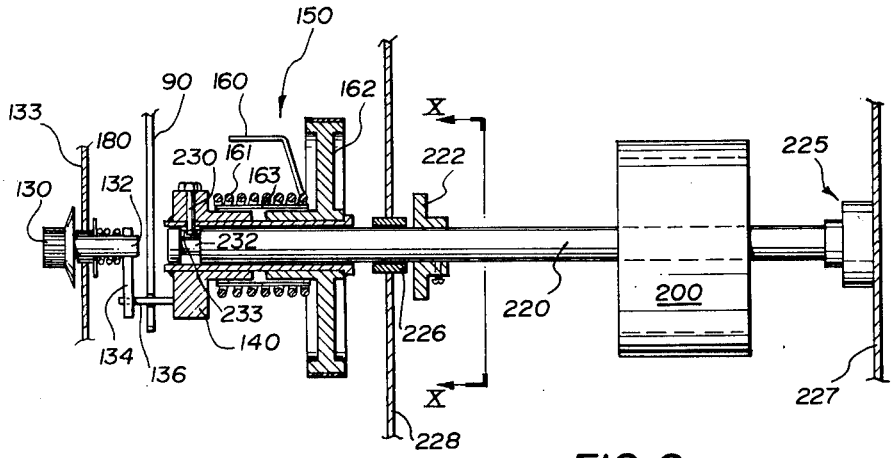
Figure 9:
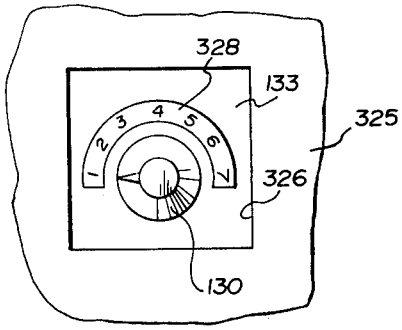
Figure 10:
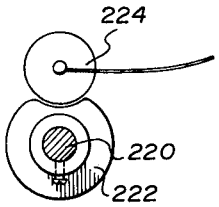
Figure 13:
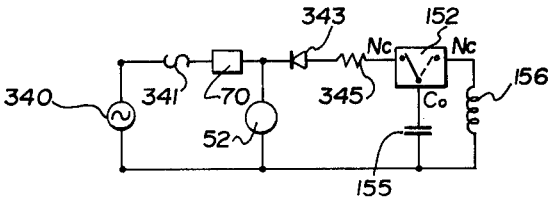
Figure 11:
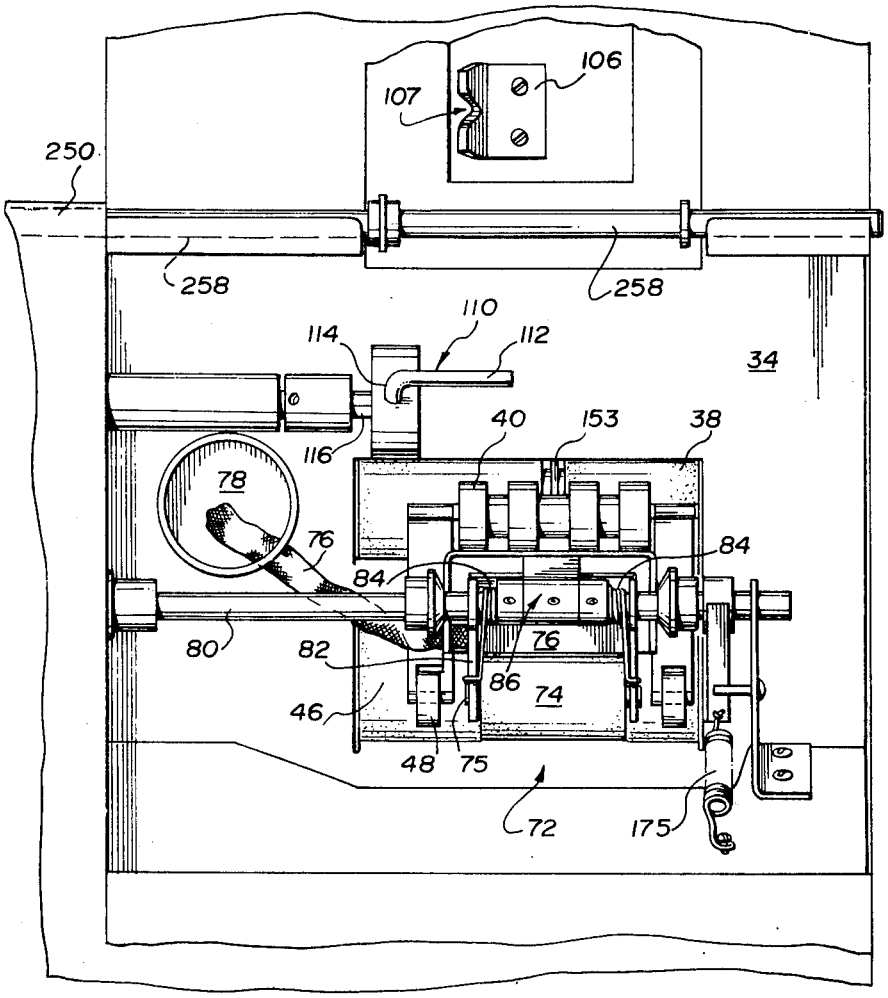
Figure 12:
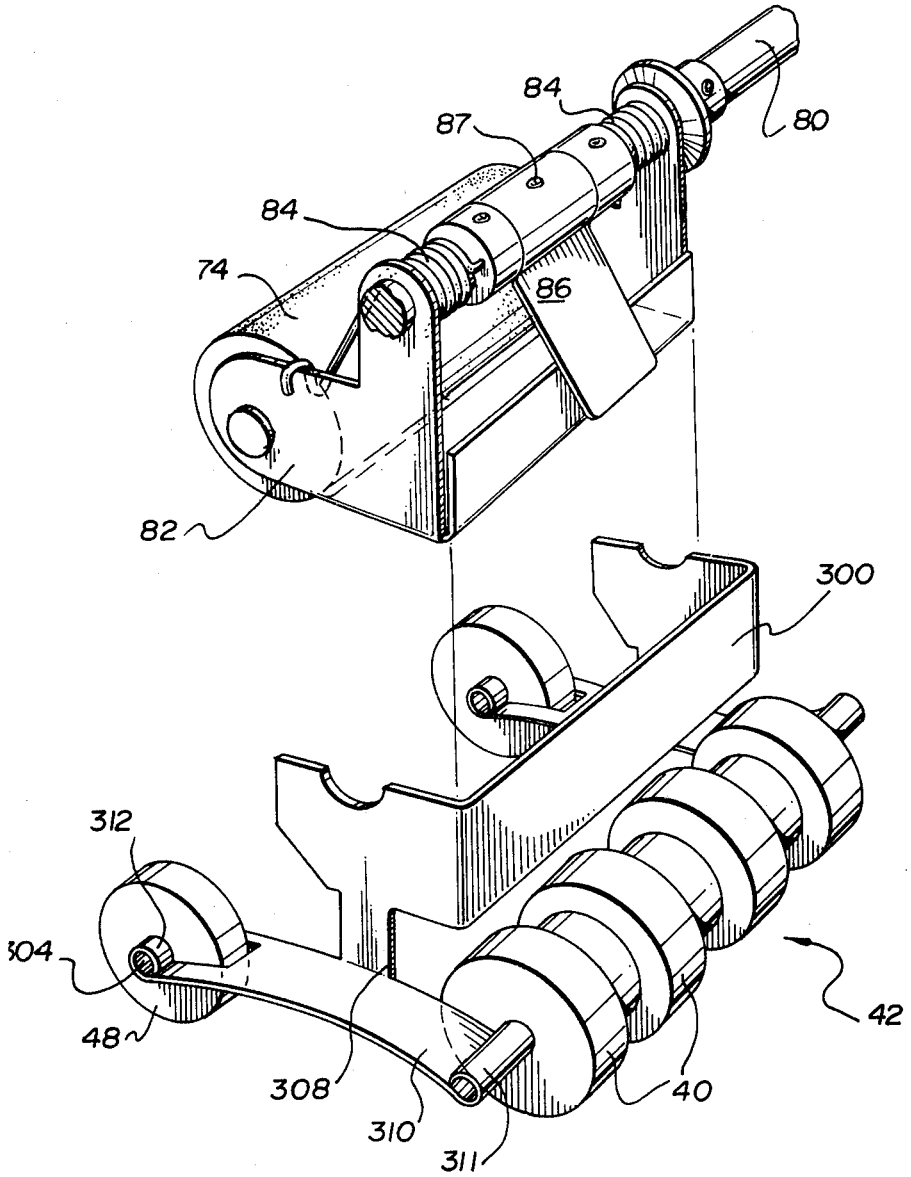

FIG. 7, is an enlarged front elevational view of the segmented printing roll and of the associated feed roll for use in the apparatus illustrated in FIG. 1, wherein the printing roll is in its starting angular position, FIG. 8 is a plan view of the printing roll, auxiliary shaft and printing roll driving system for use in the apparatus illustrated in FIG. 1, FIG. 9, is an elevational view of a portion of the back panel of the apparatus illustrated in FIG. 1, showing the manual registration control knob, FIG. 10, on the sheet of FIG. 3, is a cross-sectional view taken along line X—X in FIG. 8, FIG. 11 is a partial top plan view of the addressing apparatus illustrated in FIG. 1 with its card stacker portion pivoted in the open position for showing internal components, FIG. 12 is a perspective view of the moistening roll assembly and of an assembly of spring biased rolls for use in the addressing apparatus illustrated in FIG. 1 and, FIG. 13 is a circuit diagram.

The illustrated embodiment of this invention will now be described in detail with reference to the accompanying drawings wherein the same reference numerals are repeated in the various figures for identifying the same components.

The addressing apparatus shown in the figures operates under the well known hectographic principle using cardboard master cards whose back surface contains data to be printed in the form of carbon traces. In operation the addressing machine applies solvent spirit to the front face of the envelope and presses the back surface of one master card against the moistened area of the envelope to cause transfer of a small amount of the carbon from the master card onto this area of the envelope. Registration of the master card and of the envelope or workpiece must be adequately controlled because solvent is only applied over the area of the envelope to be printed, and registration must be adjusted to conform to the various envelope sizes.

The illustrated addressing apparatus comprises a master card holder 10 for receiving a stack of master cards 12 as seen in FIG. 4. The master cards 12 are conventionnal cardboard master cards having an information bearing area over which the data to be reproduced is printed by handwriting or by typing while a carbon bearing sheet is held against the back surface of the master card. Such master cards and carbon sheets are widely used in the trade and need no be described in greater detail as they do not form part of the invention. As will be described below, a dispensing means 14 automatically feeds the master cards one by one from the card holder 10 through a slit (not shown) located in the lower region of wall 16 in holder 10 to pairs of rotating master card nip rollers 18 to the printing station 20. The master card guiding means also comprises an elongated strip 22 of rigid but flexible material such as spring steel extending from the slit to pairs of master card extracting rollers 24 via printing station 20, and terminating at a master card discharge station or receptacle 26 seen in FIG. 1.

Workpieces are fed one by one either by hand or by a feeding machine (not shown) at the workpiece receiving station 30 defined by a table panel 32, the top surface 34 of table component 36 and a first feed roll 38 and associated spring biased nip rollers 40 which are part of the lower assembly 42 illustrated in FIG. 12 and to be described in detail below. Workpieces are translated from the receiving station 30 to the printing station 20 and thence to a workpiece discharge station by guiding means comprising the top surface 34 of table component 36, feed roll 46 with its associated spring biased rollers 48 also part of assembly 42, and feed roll 50. Electric motor 52 provides means for driving feed rolls 38, 46 and 50 at the same linear speed and in the same direction by means of a first chain 54 and sprockets 55, 56, 57 and 58. Sprocket 58 is coupled to an other sprocket 60 which drives a second chain 62 for rotating shafts 64 and 66 that carry rollers 68 and 18 as best shown in FIGS. 5 and 6. Second chain 62 therefore is used for driving the master card nip rollers 18 and extracting rollers 24 described above. Thus when manual switch 70 seen in FIGS. 5 and 13 is switched to the ON position, motor 70 continuously rotates feed rolls 38, 46 and 50 and also rollers 18 and 68 to thereby translate master cards and workpieces toward their respective discharge stations 26 and 44.

For printing by the hectographic process, solvent must be applied to the area of the workpiece to be printed and to this effect a normally inactive moistening system is used at station 72 which only applies solvent at a given time during each printing cycle. Moistening station 72 is located immediately upstream of printing station 20 and comprises a freely rotatable moistening roll 74, best seen in FIGS. 11 and 12, whose axis 75 is parallel to that of feed roll 46 and moveable toward and away therefrom. Wick 76 contacts the periphery of moistening roll 74 and communicates with a supply of solvent 78. Cross-shaft 80 supports a bracket 82 which carries moistening roll 74. Coil springs 84 urges bracket counter clockwise relative to shaft 80 which however supports an abutment 86 for bracket 82. Abutment 86 is secured to shaft 80 by means of set screw 87. When shaft 80 is displaced counterclockwise, springs 84 cause lowering of moistening roll 74 toward feed roll 46 thus applying solvent to the workpiece passing therebetween. When shaft 80 is moved back to its position of rest seen in FIGS. 2 and 4, the workpiece can pass freely through moistening station 72 without any further application of solvent. The rocking motion of cross-shaft 80 is obtained by means of slotted link 90 and crank arm 92 seen in FIGS. 5 and 6 and to be described in detail below.

The apparatus master card dispensing means 14 noted above comprises a reciprocating knife or blade 100 riding along slots 102 in the bottom surface 104 of card holder 10 and terminating into a lug 106 which presents a V-shaped opening 107. A L-shaped actuating finger 110 as seen in FIGS. 2, 4 and 11 has a free arm 112 engaging slot 107 and radial arm 114 secured to cross-shaft 116 whose other end carries a crank arm 120 coupled to crank arm 92 by secondary link 122. By pivoting shaft 116 counterclockwise (as viewed in FIGS. 2, 4 and 5) free arm 112 moves blade 100 downwardly thus pushing the lowermost card 12 through the slot in wall 16 sufficiently for the leading edge of the card to be picked up by roller 18. Operation of the card dispensing means and of the moistening station 72 is thus made in synchronism by the noted system of links 90 and 122 to insure that in every printing cycle the area of the workpiece to be printed (receiving the solvent) will be in registry with the information bearing area of the master card being translated when they reach printing station 20.

Means is provided for adjusting the distance between the leading edge of the workpiece and the area of the workpiece to be printed, which includes a manual control knob 130 on the outer end of a short sliding shaft 132, projecting through wall member 133 as best seen in FIG. 8. A small crank arm 134 on the inner end of shaft 132 carries a pin 136 which extends through a hole in slotted link 90 and projects into one of the axial bores 138, seen in FIG. 6, of driven member 140 of clutch 150. A microswitch 152, shown in FIGS. 4 and 13, has a whisker or trigger arm 153 so located in the apparatus as to be moved by the leading edge of a workpiece in receiving station 30 to thus close the normally open contact of microswitch 152 and cause an electrical signal, i.e. discharge of capacitor 155 through winding 156 of solenoid 157 shown in FIG. 6. As a result, plunger 158 retracts to free spring extension 160 of spring clutch 150 whose driving side is rotated by motor 52 by means of gear 162 meshing with gear 164 which is secured to sprocket 60.

In operation, when the leading edge of a workpiece actuates whisker 153 located in a central groove of feed roll 38, clutch 150 engages to rotate driven member 140 which therefore causes slotted link 90 to move in the manner of a connecting rod as best shown in FIGS. 5, 6 and 8. At the end of slot 170 of slotted link 90 a certain amount of lost motion takes place but throughout each revolution of driven member 140 crank arm 92 is forced to move counterclockwise (as viewed in FIG. 5) just sufficiently to permit application of solvent on the translating workpiece by moistening roll 74 via shaft 80. Simultaneously, link 122 pulls crank arm 120 to turn shaft 116 sufficiently for blade 100 to feed the lowermost master card 12 which is picked up by nip rollers 18. A tension spring 175 (FIG. 11) acting on a collar secured to shaft 80 returns crank arms 92 and 120 to their rest position seen in FIGS. 5 and 6. It will be seen that by pulling knob 130 and placing pin 136 in a different one of holes 138 and releasing knob 130 which is pulled inwardly by coil spring 180 (FIG. 8) a different angular displacement of the first feed roll 38 will take place between triggering of the microswitch 152 and initiation of the common actuating means 90, 92, 122, 120 function. In effect, this allows the operator of the addressing machine to move the printed area on the length of the workpiece closer or farther from the leading edge thereof. Adjustment of the position of control knob 130 must of course be effected when no workpieces are being printed because knob 130 rotates with driven member 140 i.e. when clutch 150 is engaged. As will be seen from the following description of the printing station, the distance between the two possible extreme positions of the printed area on a workpiece is directly proportional to the diameter of segmented printing roll 200 which consequently is quite large as seen in FIG. 7.

Printing station 20 comprises feed roll 50 (whose supporting shaft 202 is rotated without interruption by motor 52, sprocket 55, chain 54 and sprocket 58) and segmented printing roll 200 of relatively large diameter made of soft rubber or like material. Roll 20 has a flat portion 204 and a circular portion 206, and its rest position is as shown in FIG. 7, with its flat surface 204 slightly inclined to facilitate insertion of workpieces as at arrow 208 and master cards 12 as at arrow 210. Printing roll 200 is secured to auxiliary shaft 220 which supports clutch 150 at its rear end and which is parallel to but spaced from feed roll 50. The starting angular position of printing roll 200 and shaft 220 is determined by cam 222 secured to shaft 220 and spring biased roller follower 224 seen in FIG. 10 but omitted from FIG. 8 for clarity (where such would otherwise appear immediately above cam 222). Auxiliary shaft 220 is retained by bushings 225, 226 in walls 227, 228 as best seen in FIG. 8 and is driven into rotation by driven member 140 and the radial projection or pin 230 thereof which extends inwardly into the central bore in driven member 140 into which shaft 220 extends. Shaft 220 has a groove 232 near its rear end and a raised portion 233 in groove 232 defines a longitudinal projection across groove 232. Projection 233 is sufficiently high to be engaged by pin 230 when clutch 150 is engaged and this rotates shaft 220. Otherwise shaft 220 is freely rotatable in bushings 225, 226 and relative to clutch 150. In summary the coupling of driven member 140 and auxiliary shaft 220 provides lost motion for delaying rotation of the shaft after engagement of the clutch 150 upon closing of microswitch 152.

With reference to FIG. 7, the distance between shafts 202 and 220 is fixed and sufficient to leave a gap between flat surface 204 of printing roll 200 when in its starting position (as shown) and the periphery of feed roll 50, the gap must be wide enough to permit free movement of the workpiece between these two components when the printing roll is inoperative but the distance between shafts 202 and 220 must be such as to ensure substantial flattering of the narrow soft rubber printing roll 200 when its round surface 206 contacts feed roll 50 whose rubber hardness is comparatively high. In effect therefore the large print roll's surface 206 will somewhat spread over the master card and cause the mating surfaces of the master card and workpiece to remain pressed together for a longer period of time than if not flattering of printing roll 200 was allowed and a darker printing will result. It follows that the pressure exerted across the master card and workpiece in the printing station is of lesser importance and need not be as high as would otherwise be required and there is no further need for the use of two successive printing stations.

In operation when a workpiece and a master card thereover reach printing station 20, raised portion 233 in groove 232 of shaft is contacted by pin 230 of driven member 140 (FIG. 8) which drives printing roll 200 over a sufficient angular distance for its circular surface 206 to reach feed roll 50 through the workpiece and master card. From then on driving is accomplished by feed roll 50, and consequently printing roll 200 will continue to turn even after disengagement of clutch 150 until the end of circular surface 206 whereupon cam follower 224 will force cam 222, shaft 220 and printing roll 200 to assume their initial starting position until the follow printing cycle. Thus engagement of the printing roll and the master card with the workpiece and feed roll 50 underneath only takes place a fixed period of time after closing of microswitch 152 and discharge of capacitor 155 as determined by the angular relationship of driven member 140 and the raised portion 233 in groove 232 of shaft 220 when these components are in their starting or inactive position.

The printing roll driver therefore comprises a single normally disengaging clutch 150 whose driving shaft 162 seen in FIG. 8 continuously rotates with the feed rolls 38, 46 and 50 under the action of motor 52, and driven member 140 is caused to rotate with the driving half 162 when spring extension 160 is released as a result of contraction and closing of the coils of spring 161 and the underlying cut sleeve 163 seen in FIG. 8.

As noted above, an intermediate feed roll 46 parallel to the first feed roll 38 is located immediately below moistening roll 74 and serves to support the workpiece during application of solvent.

The frame housing of the illustrated apparatus consists of a table component 36, a back component 250 secured to table component 36 and a cantilevered top component 252 secured to back component 250 and disposed over the top surface 34 of table component 36 as seen in FIGS. 1 and 3. There is a space between the top component 252 and table component 36 for passing the workpiece. Top component 252 has a horizontal member 254 which extends over the workpiece receiving station 30 and over the moistening station 72. Member 254 defines the master card holder 10 and is pivotally connected to the frame housing by pin 258 anchored to back component 250. When member 254 is pivoted to its open position shown in FIG. 11, it gives access to the workpiece receiving and moistening stations 30, 72 components.

Components 36, 250 and 252 are made of relatively thin sheet metal and comprise a vertical prestressing bar 260 shown in FIGS. 3 and 6. Back component 250 and table component 36 are bolted together as at 261, 262, and top component is secured to back component by bolts 263. However, a screw 264 threading into bar 260 urges the top component away from bar 260 thereby to strengthen the frame housing and prevent separation of the top component 252 from table component 36 during printing. To this effect, bar 260 is located vertically in the vicinity of auxiliary shaft 220. Bar 260 is of great stifness being an angle iron of about $\frac{1}{2}$ by $\frac{3}{4}$ of an inch. It has been found preferable to also weld together back component 250 and table component 36.

FIG. 12 illustrates roller assembly 42 located immediately below the moistening assembly on the end of cross-shaft 80. Assembly 42 comprises a sheet metal frame 300, a series of leading spring biased rollers 40 on shaft 302 and a pair of trailing rollers 48 on pins 304. The upper edge of metal frame 300 comprises two indentations forming seats for fitting underneath cross-shaft 80 on either sides of the moistening roll bracket 82. Legs 308 extend downwardly to the center of horizontal leaf springs 310 whose opposite ends are curved so as to define sleeves 311 and 312 that support shaft 302 and pins 304 respectively. In position as shown in FIGS. 2 and 11, rollers 40 bear against feed roll 38 and rollers 48 bear against feed roll 46. For repair or for removing a jamming workpiece in the moistening station 72, the roller assembly 42 can be removed by pulling the assembly toward rod 258 as seen in FIG. 11.

The back of the apparatus can be seen in FIG. 6 with the cover 325 removed. Such cover is intended to be held in place by corner screws fitting in threaded holes 320. This cover 325 of which a portion can be seen in FIG. 9 consists of a rectangular sheet of plastic or metal and has a square opening or window 326 for giving access to knob 130 also seen in FIG. 8 but removed from FIG. 6 for clarity. Shaft 132 which mounts knob 130 is supported in a bushing in vertical strip 133 seen in full lines in FIG. 8 and in chain lines 133 in FIG. 6. This strip 133 is secured to the top and bottom edges of the back component 250 and a portion thereof shows through window 326 of cover plate 325. Indices 328 on strip 133 enable the operator to select the desired registration for the size of workpieces being printed.

Referring now to the circuit diagram of FIG. 13, the source of household voltage 340 supplies motor 52 through fuse 341 and main switch 70 and charges capacitor 155 through rectifier 343 resistor 345 and the normally closed (NC) contact of microswitch 152. When microswitch 152 is actuated its moving arm opens the charging circuit of capacitor 155 and causes the capacitor 155 to send a pulse through the winding 156 of the solenoid via the normally open (NO) contact of microswitch 152.

As described above printing roll 200 is made of relatively soft rubber or like material, and although its hardness is not critical it should preferably be softer than the underlying feed roll 50 and subtantially softer than the printing rolls normally found in prior existing hectographic addressing machines. Experiences has shown that with a feed roll hardness of 80 Durometer, the rubber hardness of printing roll 200 should be of the order of 40 Durometer. The large diameter of the printing roll is quite important; if enough registration adjustment range is desired. The exact dimension is not critical as long as the distance between shafts 202 and 220 is controlled for proper engagement of the surfaces of feed roll 50 and printing roll 200. Proper printing and adequate registration range have been obtained with a printing roll whose diameter is 3 inches whose length is about 1½ inches and whose flat surface 204 measures 2¼ inches with a feed roll measuring about 4 inches long and about 1½ in diameter; the distance between the axes of shafts 202 and 220 being equal to half the sum of the diameter of printing roll 200 and of feed roll 50 less ⅛ of an inch. The width of printing roll 200 should be at least equal to the height of the information bearing area on the master cards but not considerably more in order to minimize the force required to rotate it during each printing cycle.

We claim:

1. A hectographic apparatus for printing information on envelopes and similar workpieces from master cards each of which having an information bearing area, comprising a master card holder for receiving a stack of master cards, master card dispensing means for automatically feeding said master cards, card guiding means for translating dispensed master cards from said holder to a printing station and from said printing station to a master card discharge station, a first feed roll defining a workpiece receiving station, workpiece guiding means for translating workpiece from said workpiece receiving station to said printing station and from said printing station to a workpiece discharge station, drive means for rotating said first feed roll throughout every printing cycle, moistening means defining a moistening station upstream of said printing station for applying solvent only over the area of said workpiece to be printed, common actuating means for operating said master card dispensing means and for operating said moistening means in synchronism to insure that in every printing cycle the area of the workpiece being translated over which solvent is applied is in registry with the information bearing area of the master card being translated, sensing means for producing an electrical signal when the leading edge of a workpiece at said workpiece receiving station reaches a predetermined point in said apparatus, and registration adjustment means for adjusting the distance between the leading edge of a workpiece and the area of said workpiece to be printed, said registration adjustment means including a manual control for determining the angular displacement of said first feed roll taking place between the occurence of said electrical signal and the beginning of the operation of said common actuating means, said printing station comprising a second feed roll driven by said drive means, the axes of said first and second feed rolls being parallel to each other the linear speed of said first and second feed rolls being equal and in the same direction, said printing station also comprising a narrow segmented printing roll made of soft material and having a non-circular portion, and secured to an auxiliary shaft which is parallel to and spaced apart from the axis of said second feed roll, said auxiliary shaft being normally freely rotatable, the distance between the axis of said auxiliary shaft and that of said second feed roll being fixed and sufficient to leave a gap between the non-circular portion of said printing roll and the periphery of said second feed roll, but said distance being sufficiently short to ensure substantial flattening of said printing roll by said second feed roll when their circular surfaces meet; said apparatus also comprising a printing roll driver for causing engagement of said second feed roll and printing roll by rotating said printing roll a fixed period of time after receiving said electrical signal, and printing roll stop means for setting the starting angular position of said printing roll each time the periphery thereof looses contact with said second feed roll thus maintaining said gap until the next operation of said printing roll driver.

2. Apparatus as defined in claim 1 wherein said drive means consists of a small electric motor which maintains continuous rotation of said first and second feed rolls, wherein said printing roll driver comprises a single normally disengaged clutch having a driving member continuously rotating under the action of said small electric motor, and a driven member coupled to said auxiliary shaft for rotating said auxliary shaft.

3. Apparatus as defined in claim 2 wherein the coupling of said driven member to said auxiliary shaft provides lost motion for delaying rotation of said auxiliary shaft after engagement of said clutch which occurs practically simultaneously with said electrical signal.

4. Apparatus as defined in claim 3 wherein said coupling consists of a radial projection in said driven member extending inwardly into a bore through which said auxiliary shaft extends, and a longitudinal projection in said auxiliary shaft interfering with said radial projection, the relative angular position of said projections being such as to permit rotation of said driven member from its engagement position over a predetermined angle before engagement of said projections takes place.

5. Apparatus as defined in claim 2 comprising a third feed roll driven by said drive means and whose linear speed is equal to that of said first and second feed rolls and in the same direction, the axis of said third feed roll being parallel to those of said first and second feed rolls and being disposed therebetween immediately below said moistening means, said moistening means comprising a freely rotatable moistening roll whose axis is parallel to that of said third feed roll and moveable toward and away therefrom, and a wick contacting the periphery of said moistening roll and communicating with a supply of solvent, said apparatus being further characterized in that: said common actuating means comprises a slotted link having one end pivotally connected to a point of said driven member which is disposed at a predetermined distance from the axis of rotation of said driven member, a first cross-shaft having a first crank arm at its inner end and said moistening means at its outer end, a second cross-shaft having a second crank arm at its inner end and an actuating finger at its outer end, a secondary link extending between said first and second crank arms and pivotally connected thereto, and a pin extending through the slot at the other end of said slotted link and into said first crank arm, and said apparatus being further characterized in that said registration adjustment means comprises a plurality of closely spaced apart axial bores on the free end of said driven member, and a retractable pin extending through said slotted link into one of said bores which are all at said predetermined distance from the axis of rotation of the driven member.

6. Apparatus as defined in claim 5 wherein said actuating finger is L-shaped having a radial arm secured to said second cross-shaft and a free arm parallel to and spaced apart from said second cross-shaft, said free arm engaging into a V-shaped opening in a lug of said card dispensing means, said lug being connected to a stripping blade for moving same thereby to feed said master cards one by one.

7. Apparatus as defined in claim 5 wherein said registration adjustment means also comprises a knob on the outer end of a spring loaded shaft whose axis coincides with that of said auxiliary shaft, and a small arm secured to the inner end of said spring loaded shaft and carrying said retractable pin.

8. Apparatus as defined in claim 1 comprising a frame housing which consists of a table component, a a back component secured to the table component and a cantilevered component secured to the back component and disposed over said table component leaving a space therebetween for passing said workpieces, said cantilevered component having a horizontal member extending over said workpiece receiving station and over said moistening station and defining said master card holder, said horizontal member being pivotally connected to said frame housing so as to be pivoted to an open position for giving access to said workpiece receiving station and to said moistening station.

9. Apparatus as defined in claim 8 wherein said table component, said back component and said cantilevered components are made of sheet metal and comprise a vertical prestressing bar of great stiffness secured into said back component to said table component and to said cantilevered component in the vicinity of said auxiliary shaft, and a screw threading into said prestressing bar and urging the free end thereof away from the underlying portion of said frame housing.

10. Apparatus as defined in claim 1 wherein the hardness of the printing roll is of the order of 40 Durometer and that of said second feed roll is of the order of 80 Durometer.

11. Apparatus as defined in claim 10 wherein the width of said printing roll is about 1½ inches, its diameter is about 3 inches and said non-circular is a flat peripheral surface and the length of said flat peripheral surface is about 2¼ inches.

* * * * *